US006209743B1

(12) United States Patent
Karpisek

(10) Patent No.: US 6,209,743 B1
(45) **Date of Patent: *Apr. 3, 2001**

(54) COLLAPSIBLE CONTAINER WITH INNER LINING SURFACE

(76) Inventor: Ladislav Stephan Karpisek, 92 Woodfield Boulevarde, Caringbah, New South Wales 2229 (AU)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/581,194

(22) Filed: Jun. 14, 2000

(30) Foreign Application Priority Data

Dec. 8, 1997 (AU) ..... PP0821

(51) Int. Cl.[7] ..... B65D 6/00
(52) U.S. Cl. ..... 220/6; 220/9.2
(58) Field of Search ..... 220/6, 9.2, 495.01, 220/495.06

(56) References Cited

U.S. PATENT DOCUMENTS 2,756,894 * 7/1956 Phillips ..... 220/6
4,735,330 4/1988 Hoss ..... 220/6
5,370,256 * 12/1994 Fourie et al. ..... 220/6
5,622,276 * 4/1997 Simmons ..... 220/6
5,730,307 * 3/1998 Karpisek ..... 220/6

FOREIGN PATENT DOCUMENTS 1005892 7/1992 (AU) .
4823496 10/1996 (AU) .

* cited by examiner

*Primary Examiner*—Steven M. Pollard
(74) *Attorney, Agent, or Firm*—Edwin D. Schindler

(57) ABSTRACT

A collapsible container with four side panels (15,16,17,18) all permanently connected to a base (1) by links (11,41) allowing the panels (15,16,17,18) to be moved between an upstanding condition on the base (1) where they are retained by engagement of bottom panel flanges (40) with channels (13,14) on the base (1) and can be coupled by coupling means (19,23) releasably secured by securing means (21,22) thereby to form an enclosure and allowing the container to be collapsed by folding down the panels (15,16,17,18) into an overlying relationship.

5 Claims, 4 Drawing Sheets

COLLAPSIBLE CONTAINER WITH INNER LINING SURFACE

FIELD OF THE INVENTION

This invention relates to collapsible containers, and in particular to containers having a base and four panels permanently coupled to the base and able to fold down, from an erected condition where the panels are upstanding from the base, into a stack of overlying panels which overlie the base.

BACKGROUND TO THE INVENTION

A typical container of the above type is illustrated in Australian patent 694001. That container there are two side panels and two end panels and each panel is made up of a rectangular frame with a lining sheet over the frame to provide a smooth inner face for the panel. For hygienic reasons the lining sheet is usually of made of plastic. The plastic sheeting is of substantial thickness, about 6 mm, to provide the strength required to cover the openings in the panel frame, however, as with many plastics, lining sheet expands substantially when heated. Containers of the type under consideration are often exposed to conditions, such as strong sunlight, which can result in the plastic undergoing considerable expansion and buckling (inward bulging) between the fasteners whereby the plastic sheeting is fixed to the panel frame.

The erection of the panels of a container of the above form is a two step operation. First, the side panels (which are the uppermost pair in the stack of panels on the base) are erected and then the end panels are erected. Because the length of the end panels is substantially equal to the spacing apart of the side panels when erected anything which reduces that spacing will hinder, if not prevent, erection of the end panels. It has been found heat from the sun on a collapsed container can cause buckling of the plastic sheeting of the panels to the extent that it is impossible to erect the end panels of the container. This invention has been devised to address the foregoing problem.

BROAD STATEMENT OF THE INVENTION

A collapsible container having a base and two side panels and two end panels with all of the panels coupled to the base in a manner allowing the panels to be folded down over each other and the base, each of said side panels has an inner surface with two marginal zones upstanding from said inner surface at ends of the side panel and running substantially the full length of each of said ends, the spacing between corresponding raised zones of the side panels when upstanding from the base at opposite sides of the base is substantially equal to the length of the end panels between ends of the end panels.

GENERAL DESCRIPTION OF THE DRAWINGS

Figure 1:
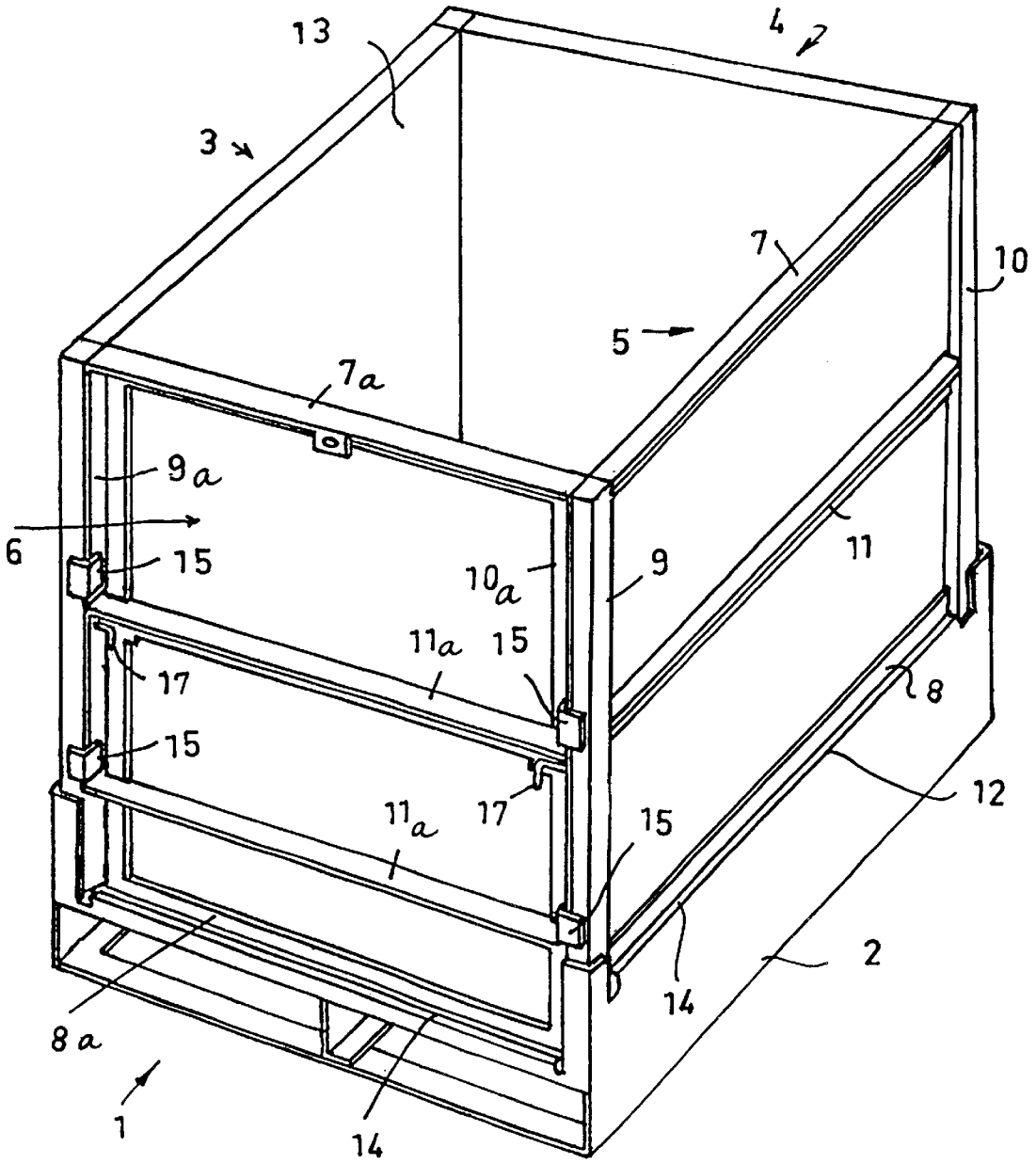
Figure 2:
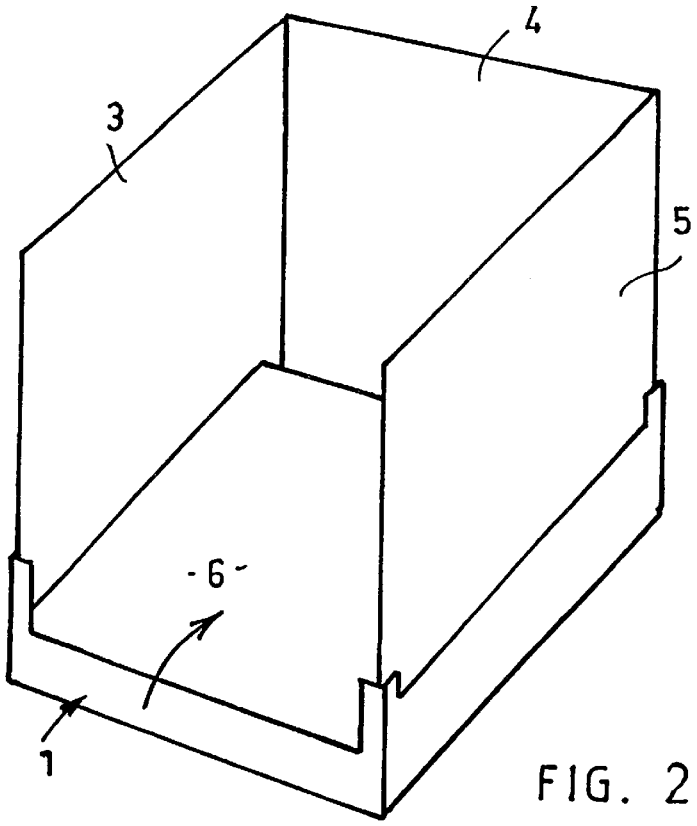
Figure 3:
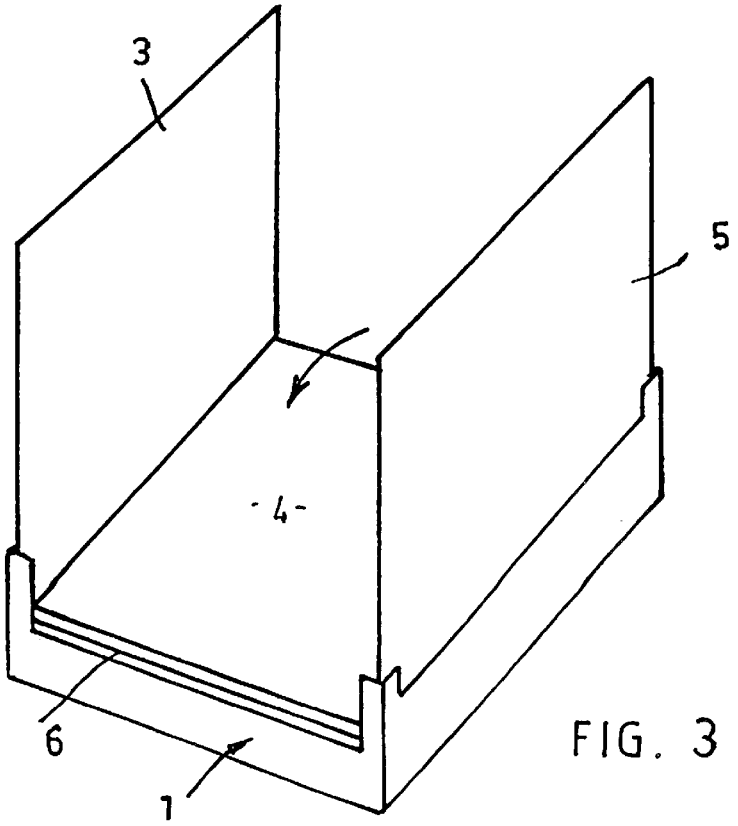
Figure 4:
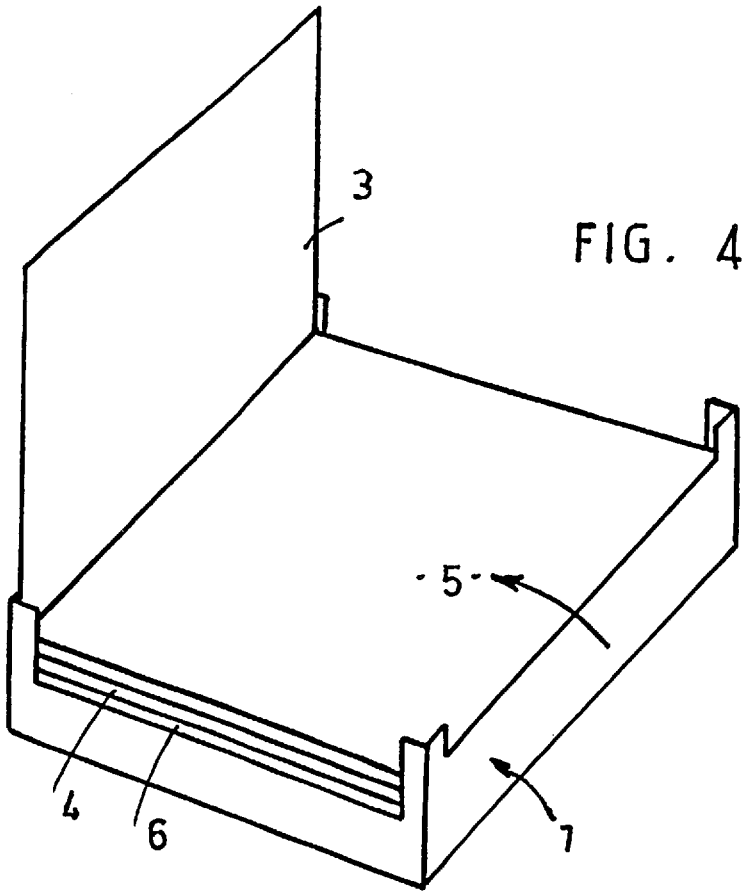
Figure 5:
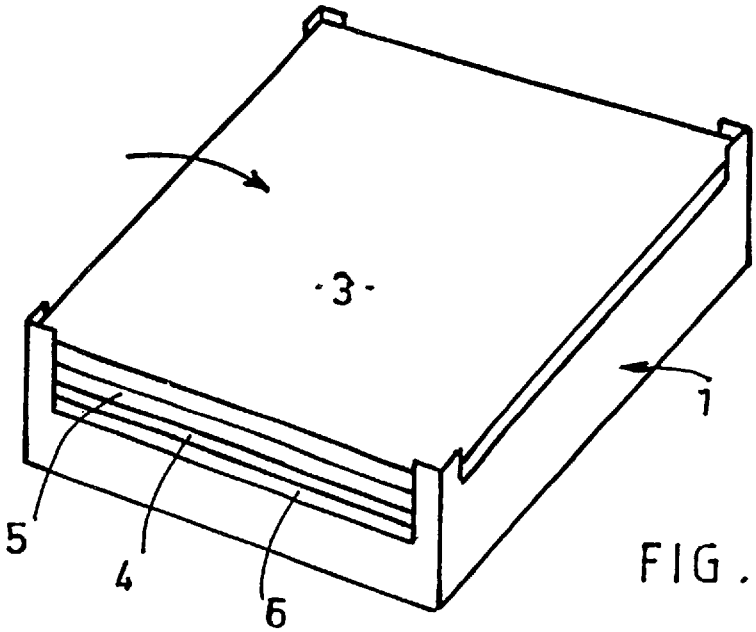
Figure 6:
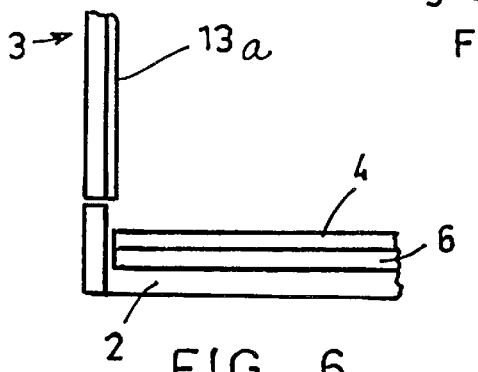
Figure 7:
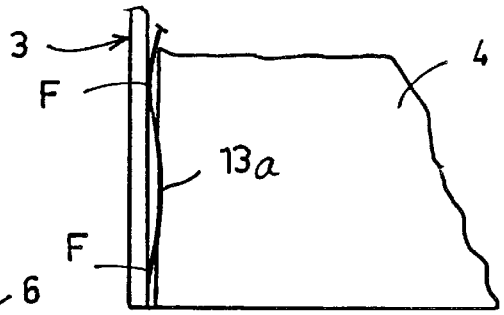
Figure 8:
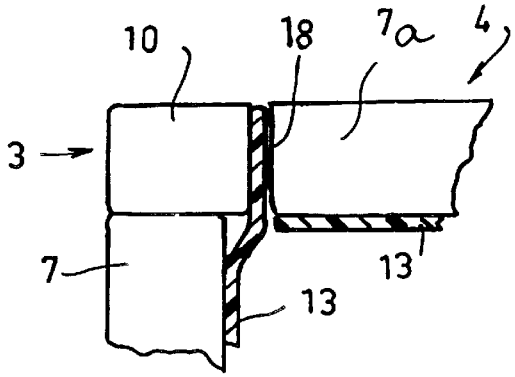
Figure 9:
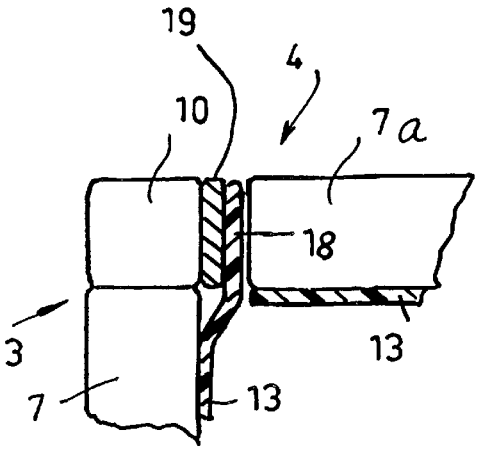

FIG. 1 is a perspective view of a container typical of the type to which the present invention would be applied, FIG. 2 schematically illustrates the first step in the sequence in which the panels of the container of FIG. 1 are folded down over the base, one end panel being first folded down, FIG. 3 is a view similar to FIG. 2 showing the other end panel folded down, FIG. 4 is a view similar to FIG. 2 showing one side panel folded down, FIG. 5 shows all panels folded down over the base, FIG. 6 is a fragmentary end elevation schematically illustrating the circumstances which would interfere with the raising of an end panel following buckling of the plastic sheeting fixed to a side panel, FIG. 7 is a fragmentary plan view of the conditions which apply in FIG. 6, FIG. 8 illustrates the invention as applied to a container and FIG. 9 shows a further alternative arrangement to that shown in FIG. 8.

DETAILED DESCRIPTION OF THE DRAWINGS

In FIG. 1 the container 1 (which is of known type) has a base 2 with two side panels 3,5 and two end panels 4,6 coupled, as by links, to the base 2. One form of link coupling can be seen in Australian patent 694001, which discloses a construction in which the side panels 3,5 are not as high as the end panels 2,4 and there are plinths 12 on the base 2 to which the side panels 3 and 5 can be demountable coupled.

The side panels 3,5 each have a metal frame with an angle a top rail 7, an angle iron bottom rail 8, and upright end members 9,10 made of tubular steel. There are a two transverse intermediate bar 11. The frame of each side panels has a lining sheet 13 to provide a smooth inner surface for the side panel. The end panels 4,6 can be similarly constructed but may have the elements 7*a*, 8*a*, 9*a*, 10*a*, which correspond with the elements 7,8,9,10 of the side panels 3,5, all made of angle iron.

When erected on the base 2 each panel has a lower rail flange engaged in a channel 14 on the base (for engagement by the end panels 4,6) and on the plinths 12 (for engagement by the side panels 3,5). The uprights 9,10 of the side panels 3,5 have hooks 15 to be engaged by the end uprights 9*a*,10*a* of the end panels 4,6. Slide bolts 17 on the uprights 9*a*,10*a* engage in holes in the end uprights 9,10 of the end members to hold the adjacent uprights of the side and end panels coupled together.

It is to be noted that the width of the end panels 4,6 is substantially the same as the spacing apart of the side panels 3,5 when erected.

The link couplings between the base and the side and end panels allow the panels, after disengagement of the slide bolts 17 and the hooks 15 to fold down in a predetermined sequence to lie one over the other and all on the base. This is shown in FIGS. 2 to 5. In FIG. 2 the end panel 6 has been folded down, in FIG. 3 the end panel 4 has been folded down, in FIG. 4 the side panel 5 has been folded down, and finally in FIG. 5 the side panel 3 has been folded down.

FIG. 6 illustrates the problem with which the present invention is concerned. The end panels 4,6 are lying flat on the base 2, the side panel 5 (not shown) is in the erected condition, the side panel 3 (illustrated) is in the erected condition. Indicated 13*a* is the extent (exaggerated) to which a heat expansion induced bulge in the plastic lining sheet 13 fixed to side panel 3 projects (between the fixing points F) beyond the normal alignment of the sheet 13. This is further illustrated in FIG. 7. As will be clearly seen any attempt to erect the end panel 4 will be obstructed by the bulge 13*a*.

Referring now to FIG. 8, the upright 9 illustrated (and the upright 10) of the side panels 3,5 are not square tubular material with a size the same as the width of the top rail 7 (as in known arrangements) but are made of oblong tubular material with a width greater than the width of the top rail 7 of the panels 3,5. The arrangement is such that the inner face portions of the uprights 9,10 to be covered by the sheet

13 stand proud of the plane of the frame members 7,8,11. To accommodate the upstanding upright the sheet 13 is cranked, which is readily done with plastic material, and the sheet 13 is fastened to the inner face portion of upright 9 (10). The result is raised marginal zones 18 on the side panels 3,5 which upstand from inner surface of the sheets 13 of the side panels 3,5 at the ends of the side panels 3,5, with the zones 18 running substantially the full length of each of the end uprights of the side panels 3,5. The upstand of the zones 18 above the inner surface of the sheet 13 is made such as to accommodate the anticipated bulge potential between fixing points F due to expansion of the lining sheet 13 as a result of heating. The spacing between the zones 18 of two erected side panels 3,5 is designed to be substantially the same as the width of the end panels 4,6. It follows that the problem described and illustrated in FIGS. 6 and 7 is overcome by the above construction.

Whilst the embodiment using oblong section hollow tube just described is a possible solution to the problem and can be incorporated simply in new containers, the problem with existing containers needs to be addressed. By removing the lining sheet 13 of an existing container (or as an alternative to the just described arrangement using oblong hollow tube) a spacer bar 19 can be mounted on the uprights 9,10 of the side panels, as shown in scrap view FIG. 9.

It will be understood that the foregoing are preferred embodiments of the invention and changes can be made to the specific components hereinbefore described without departing from the inventive concepts herein disclosed.

By way of example, the lining sheet can be resiliently deformable so as to be caused to adopt the required profile (with a major inner surface and marginal zones) during fixing to support surfaces of the frame elements of the side panel, or, can be made of a material which can be preformed to the required profile so that it will lie on the support surfaces of the frame elements of the side panel prior to fixing to the support surfaces.

What is claimed is:

1. A collapsible container having a base and two side panels and two end panels with all of the panels coupled to the base in a manner allowing the panels to be folded down over each other and the base, each of said side panels has an inner surface with two marginal zones upstanding from said inner surface at ends of the side panel and running substantially the full length of each of said ends, the spacing between corresponding raised zones of the side panels when upstanding from the base at opposite sides of the base is substantially equal to the length of the end panels between ends of the end panels.

2. A container as claimed in claim 1 in which the side panels each comprise a frame made up of frame elements each with a support surface, the support surfaces of the frame elements other than two frame end elements are in substantially the same plane, the support surfaces of the two frame end elements upstand from said plane, and a continuous lining sheet extends across and bears on all of said support surfaces and provides said inner surface and said two upstanding marginal zones.

3. A container as claimed in claim 2 wherein the upstand of the support surfaces of the two frame end elements is provided by mounting spacer members on bearing faces of said frame end elements which bearing faces lie in substantially the same plane as the support surfaces of the other elements of the side panel frame.

4. A container as claimed in claim 2 wherein said lining sheet is made of a material which can be resiliently deformed during fixing of the lining sheet to the side panel frame members to provide the upstanding marginal zones.

5. A container as claimed in claim 2 wherein said lining sheet is made of a material which can be permanently deformed to a shape to lie on the support surfaces of the side panel frame elements prior to fixing the lining sheet to the side panel frame members.

* * * * *